United States Patent [19]

Hack

[11] 4,324,652

[45] Apr. 13, 1982

[54] FLOTATION METHOD AND APPARATUS FOR RECOVERING CRUDE OIL FROM TAR-SAND

[75] Inventor: Albert G. Hack, Denver, Colo.

[73] Assignee: Crescent Engineering Company, Denver, Colo.

[21] Appl. No.: 195,596

[22] Filed: Oct. 9, 1980

Related U.S. Application Data

[62] Division of Ser. No. 38,398, May 14, 1979.

[51] Int. Cl.[3] ..... B03B 5/52

[52] U.S. Cl. ..... 209/3; 209/18; 209/159; 209/464; 208/11 LE; 134/25.1; 134/36

[58] Field of Search ..... 209/3, 11, 13, 18, 168, 209/170, 173, 463, 464, 450; 210/221 R, 221 P; 208/11 R, 11 LE, 39; 422/287, 286; 196/14.52; 134/25.1, 36, 40

[56] References Cited

U.S. PATENT DOCUMENTS

| | | | |
|---|---|---|---|
| 1,984,362 | 12/1934 | Dickson | 209/464 |
| 3,043,430 | 7/1962 | Gish | 209/464 |
| 3,152,979 | 10/1964 | Bichard et al. | 208/11 LE |
| 3,357,555 | 12/1967 | Garland | 209/18 |

*Primary Examiner*—Ralph J. Hill
*Attorney, Agent, or Firm*—Edwin L. Spangler, Jr.

[57] ABSTRACT

This invention relates to an improved method and apparatus for scrubbing crude oil (bitumen) from tar-sands, the apparatus being characterized by a heated vessel for maintaining the tar-sand/water slurry at between approximately 180°–200° F., a pair of counterrotating screw conveyors in the bottom of the vessel for agitating the sand and moving it to the discharge end, means for simultaneously diluting and aerating the incoming slurry that produces small bubbles effective to float the crude oil freed from the sand to the surface, an overflow wier running alongside the vessel for catching the oil skimmed off the surface of the water, transversely-extending endless chain-and-flight skimmers for skimming the oil into the wier, a bottom-opening discharge for the clean sand, and valves controlling the discharge of sand effective to remove the latter without lowering the fluid level in the vessel to a point where the oil previously released can reattach itself to the sand. The method encompasses the steps of submerging the tar-sand in a hot water bath agitating the sand while thus immersed while continuously bubbling air up through the slurry to float the oil particles freed from the sand grains to the surface, continuously skimming off the oil floating on the water bath from the surface thereof, and withdrawing the clean sand from the bottom of the vessel intermittently and quickly enough to prevent the level of the water bath from falling below the top of the screws.

4 Claims, 6 Drawing Figures

34
70R
84
62
68
88
90
70R
C
14
56
18
36
16
38
4
54
82R
4
30
36
38
10
B
50
58
38
58
36
A
20
22
64
66
64
26
86
12
66
64

40
42
30
24S
44
48
64
52
54
32
28
14
70L
82L
10
58
18
26
38
B
16
86
56
82R
36
70R
50
54
28
12
24
30

86
94
86

FLOTATION METHOD AND APPARATUS FOR RECOVERING CRUDE OIL FROM TAR-SAND

This is a division, of application Ser. No. 038,398, filed May 14, 1979.

U.S. Government surveys, among others, have indicated that in excess of 100 billion barrels of recoverable oil reserves are present in the lower 48 States plus Alaska, all in the form of surface or near surface tar-sands. Some of these reserves, particularly those in Utah and Wyoming have a very low sulfur content and are, for this reason, particularly suitable for use as a source of liquid fuels and special purpose lubricants.

Despite this huge reserve potential, little has been done here in the U.S. to mine and refine these reserves. Instead, the major activity in North America lies in the so-called Athabasca deposit in Alberta, Canada where Canadian Oil, Ltd. in the early '70's was producing in the neighborhood of 45,000 barrels of crude per day. At least one Canadian company, namely, Great Canadian Oil Sands Limited of Toronto has patented their process for recovering oil from tar-sands, their U.S. patent carrying Pat. No. 3,607,720.

The key to efficient and economical recovery of crude from tar-sands seems to lie in the so-called "flotation cell" wherein the actual scrubbing of the sand takes place to free the oil particles clinging tightly to the surface of the sand grains. It is necessary to abraid the sand grains against one another to free the oil from the surface thereof while, at the same time, keeping the sand immersed beneath the surface of the water bath. Also, once the oil particles are freed from the sand grains, they must be treated in such a way that they end up on the surface where they are accessible and can be skimmed off. Finally, and of critical importance, is the fact that the clean sand freed of its coating of oil must not be recoated therewith because, when this happens the oil can no longer be removed effectively due to a tighter adhesion that exists the second time. The reason this happens has to do with the removal of an easily fractured acqueous interface that naturally exists between the sand grain and oil deposit coating same but which is removed during processing. Be that as it may, once separated, steps must be taken to insure that the clean sand and freed crude oil have no opportunity to get back together again.

It has now been found in accordance with the teaching of the instant invention that these and other shortcomings of the prior art tar-sand flotation cells can, in large measure, be eliminated by the simple, yet unobvious, expedient of abraiding the oil-coated sand particles against one another to free the oil therefrom while simultaneously bubbling air through the mixture to push and carry the otherwise entrapped oil particles through the sand and to the surface as the air bubbles rise. Another novel feature of the cell and method of processing tar-sands therein has to do with intermittently discharging the clean sand from the discharge end of the jacketed vessel housing the slurry being processed without, at the same time, appreciably lowering the fluid level therein and most especially not lowering it to a level below that of the screws thus preventing the latter from becoming recoated.

Individual features of the improved flotation cell of the instant invention as well as the method of processing tar-sands therein are known in the prior art; yet, certain of them when used in combination with one another accomplish certain new and unexpected results that are well beyond the skill of an ordinary artisan knowledgeable in the processing of tar-sands. For instance, the vessel itself as well as the counterrotating screw and the drives therefor are all old and have been sold for years by such manufacturers as Eagle Iron Works of Des Moines, Iowa under the well-known term "scalping tanks." This same Iowa manufacturer makes a patented valve for use in such tanks (U.S. Pat. No. 3,129,849) that senses the build-up of solids by means of a rotating paddle and utilizes the increased resistance to rotation experienced by the paddle to actuate a valve in the bottom of the tank through which a portion of the solids are discharged.

A paddle-type skimmer mounted on an endless belt and used to skim the oil floating on top of the water off into a wier alongside thereof is also a well-known expedient in flotation apparatus as exemplified by U.S. Pat. Nos. 2,746,605 and 3,539,000 both of which reveal just such a system. Heating the contents of the scalping tank by jacketing same with a jacket through which steam or hot water flows is, likewise, a more or less standard feature of various and sundry type of process equipment. Even the broad concept of floating a floatable constituent free of non-floating solids, skimming the floatables off the top and taking the non-floatables out through the bottom is a well-known expedient, especially in meat processing, the following patents all incorporating such a concept to one degree or another:

| | |
|---|---|
| Allen | 1,147,356 |
| Newton | 2,281,590 |
| Tollman | 3,616,925 |
| Irwin | 3,947,355 |
| Stone | 4,033,863 |

In addition to the foregoing patents which elements found in applicant's improved flotation cell, there are a host of prior art patents that deal specifically with processes for the recovery of bitumens from tar-sands. Among these, and in addition to U.S. Pat. No. 3,607,720 already mentioned, are the following:

| | |
|---|---|
| Kelley | 2,980,600 |
| Clark | 3,271,293 |
| Floyd et al | 3,401,110 |
| Bichard et al | 3,522,168 |
| Lubomyr | 3,565,785 |
| Brimhall | 3,605,975 |
| Rosenbloom | 3,875,046 |

While several of the above U.S. patents, notably, Nos. 3,607,720; 3,401,110; 3,271,293 and 3,522,168 specifically teach forming an emulsion by bubbling air or other gaseous medium through the hot liquid preparatory to skimming the flotation products off the top, none to applicant's knowledge teaches the unique step of grinding or otherwise abraiding the sand particles together to free the oil while simultaneously pushing the oil thus freed to the surface by bubbling air through the solids undergoing this abrasive action. By so doing, applicant is unexpectedly able to recover some 93% of the available bitumens coating the sand. The percentages of bitumens recovered by other of the prior art processes is not known specifically but one can easily see that for the most part they constitute multi-stage processes which certainly appear to be much more complicated and expensive per ton of oil recovered than applicant's essentially single stage one. This is not to infer that applicant's complete process is carried out in his flotation cell because this is not the case, but rather that the critical step of separating the bitumens from the sand is carried out in a single step within one piece of processing equipment as opposed to the prior art approach of accomplishing the separation in two or more stages.

The other aspect of the cell and its method of use that appears to be novel are the subtle, but nonetheless important, distinctions between the prior art methods and equipment used to segregate the floatable constituents from the non-floatable ones. The scalping tank equipment previously referred to is generally used in vessels when the axes of rotation of the augers are inclined, not level as in the instant flotation cell. Thus, the classification is not by means of flotation at all, but gravity. Even the bottom-dump valves are located in different sections of the tank where solids of different size settle. The essence of these prior art scalping systems, therefore, appears to be one of solid-solid classification and solid-liquid separation with little, if anything, to do with the subject matter of the instant invention, namely, separation of floatables from non-flotables.

The listed meat processing patents admittedly deal with the separation of floatables from non-floatables; however, they do so in batch processes for the most part, not on a continuous basis. More important, however, is the fact that the characteristics of the floatable and non-floatable constituents of the mix is entirely different and, for this reason, fraught with entirely different separation problems. For instance, once the fat is freed from the lean meat, the latter settles while the fat floats. Such is not the case with bitumens freed from tar-sands because much of the oil is physically trapped within the bed of sand even though rubbed free from the surface of the grains. It takes more than just the differences in specific gravity of the water and oil to accomplish the necessary physical separation, namely, an over abundance of very small air bubbles precolating up through the tumbling pile of sand so as to lift the oil particles free without causing undue turbulence of a degree which would result in sand particles being elevated to the surface of the water bath where the oil layer lies.

Accordingly, it is the principal object of the present invention to provide a novel and improved flotation cell for the extraction of bitumens from tar-sands.

A second object is the provision of a method for separating crude oil from oil-coated sands characterized by a novel aeration step wherein an over abundance of small air bubbles are percolated through the tumbling sand.

Another objective of the within described invention is to provide a single stage continuous method and apparatus effective to remove bitumens from tar-sands and permanently separate one from the other.

Still another object is the provision of such a process which results in over 90% recovery of the available bitumens while, at the same time, leaving the sand essentially clean that is being returned to the environment.

An additional object is to provide a flotation apparatus utilizing a pair of counterrotating screws turning side-by-side in horizontal relation to both scrub the oil particles off the sand grains and continuously advance the sand toward the discharge end of the cell as it progressively becomes cleaner and cleaner.

Further objects are to provide a process of the type aforementioned that is simple, efficient, good for the environment, relatively inexpensive, safe, trouble-free, versatile and susceptible of modification to suit local conditions.

Other objects will be in part apparent and in part pointed out specifically hereinafter in connection with the drawings that follow, and in which.

Figures 1, 2:
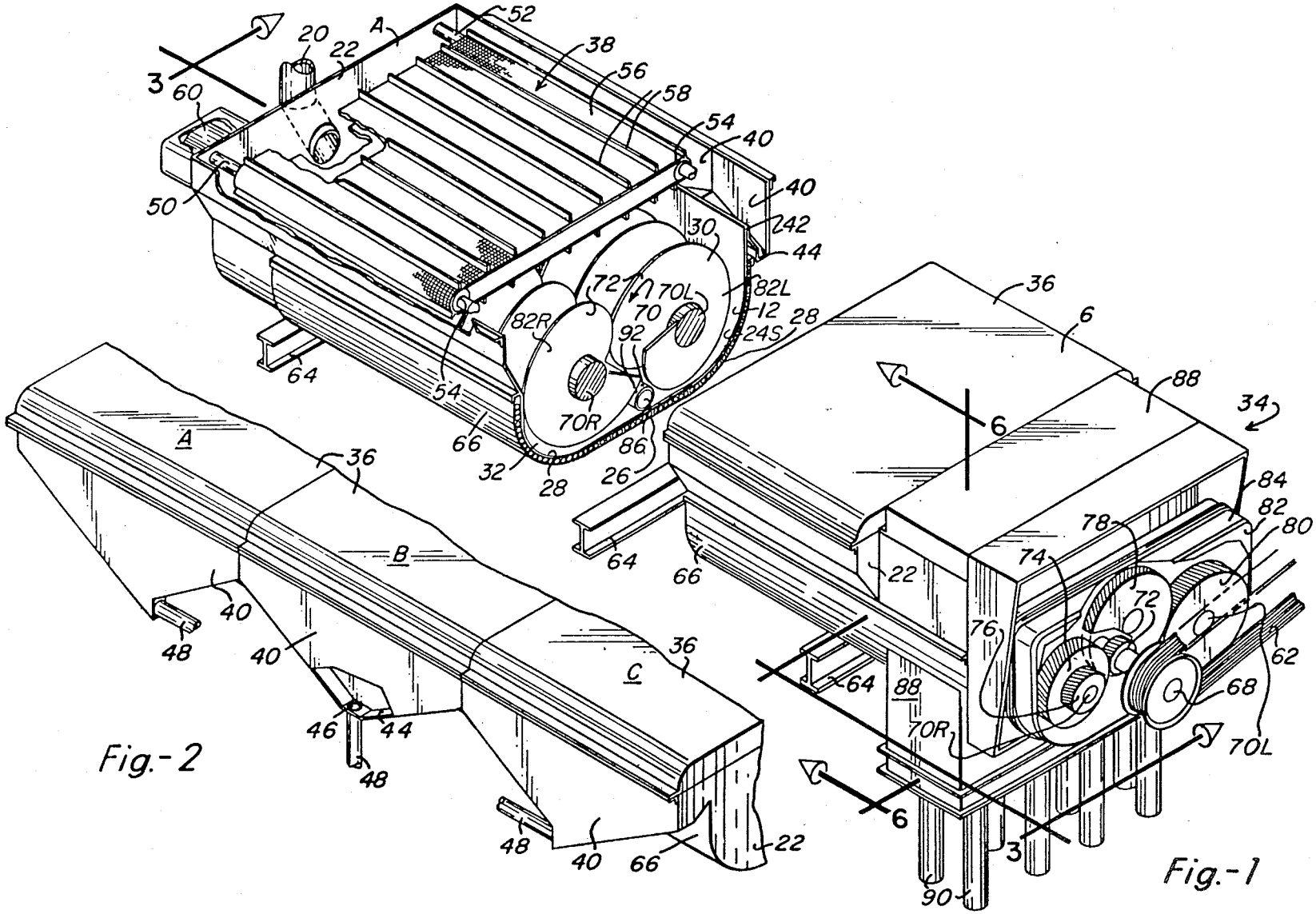
FIG. 1 is a perspective view of the flotation cell, portions of which have been broken away to conserve space while other portions have been treated in a similar manner to more clearly reveal the interior construction.
FIG. 2 is a fragmentary perspective to the same scale as FIG. 1 showing the overflow launders and the manifold interconnecting same.

Referring next to the drawings for a detailed description of the present invention, and initially to FIG. 1 for this purpose, reference numeral 10 has been selected to broadly designate the flotation cell while numeral 12 designates the jacketed vessel within which the oil 14 is scrubbed from the sand 16 and floated free thereof on the surface of a water bath 18 into which the tar-sand is introduced through inlet 20. In the specific form shown, the vessel comprises an open-topped elongate trough-like structure closed at both ends by end walls 22. The side walls 24 are curved about a large radius at the point where they join the bottom 26. Housed inside these curved corners 28 are a pair of counterrotating screw conveyors 30 arranged in horizontally-spaced side-by-side parallel relation. The corner curvature is essentially concentric with the axes of rotation of the screws while leaving a small gap 32 therebetween in a manner well known in the screw conveyor art. As these screws rotate in the directions indicated by the arrows in FIG. 4, they tumble the tar-sand so as to rub the grains together and scrub the oil from the sand particles while, at the same time, moving the progressively cleaner sand toward the discharge end of the cell, the latter having been indicated broadly by reference numeral 34.

Figure 3:
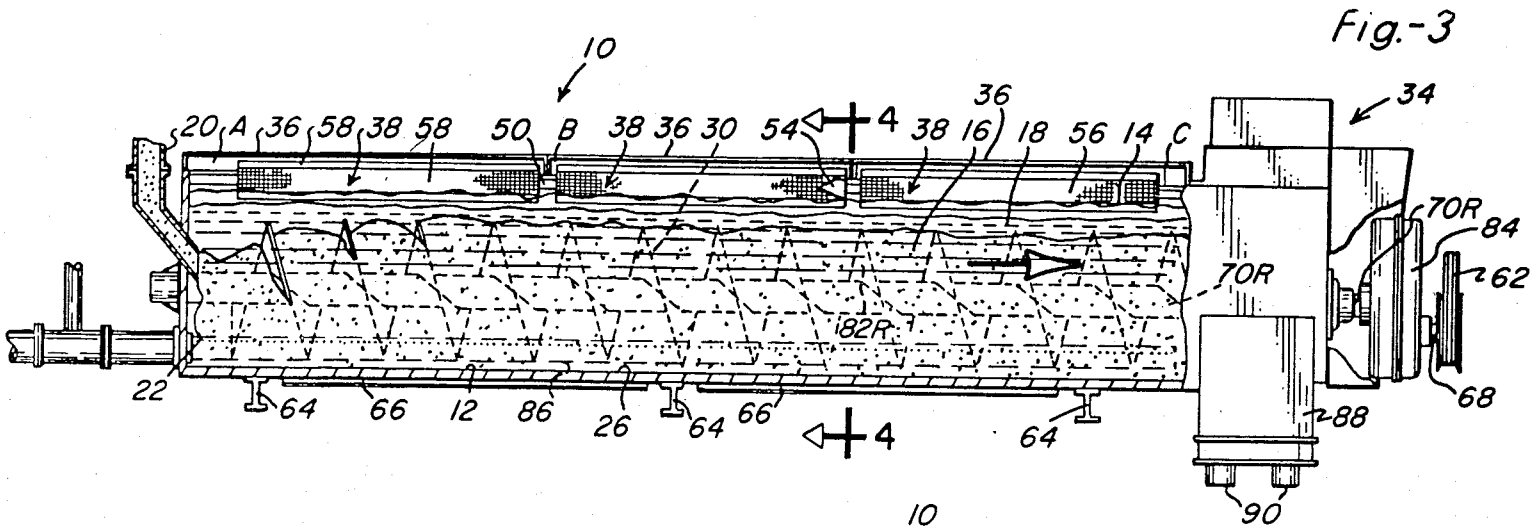
FIG. 3 is a view showing the cell to a somewhat smaller scale partly in section and partly in elevation.
Figure 4:
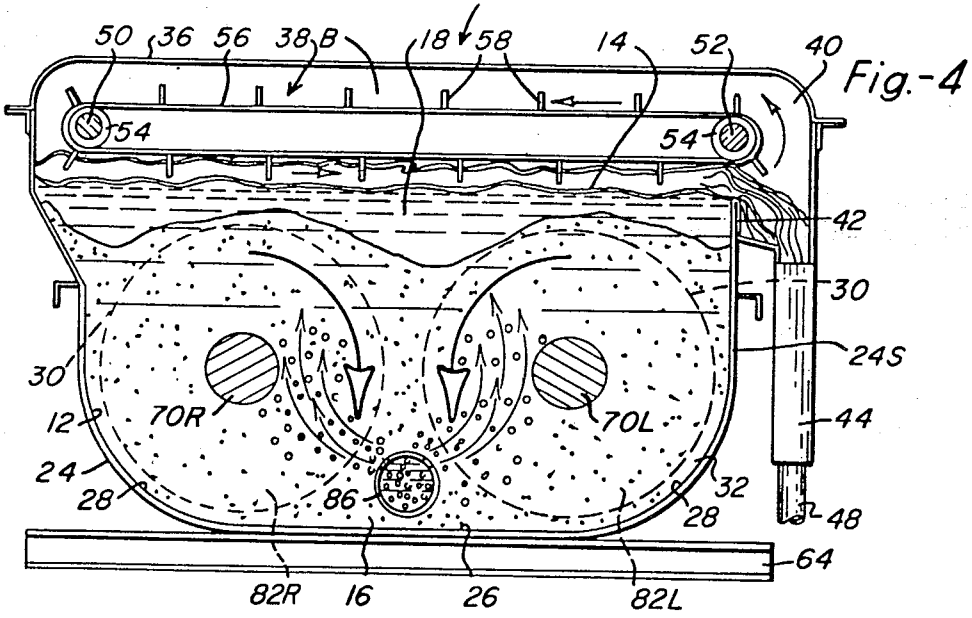
FIG. 4 is a transverse section to an enlarged scale taken along line 4—4 of FIG. 3, the jacket for heating the vessel having been removed.
Figure 5:
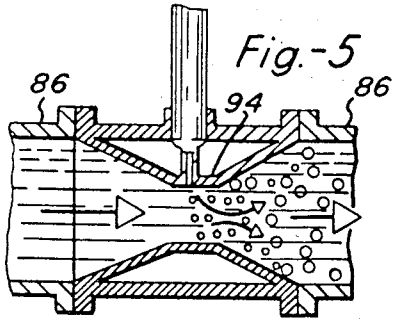
FIG. 5 is a diametrical section to even a further enlarged scale showing the air-aspirating venturi that percolates an over abundance of air and water up through the tumbling sand bed at all times; and, FIG. 6 is a fragmentary section to a scale somewhat larger than FIG. 1 taken along line 6—6 of the latter figure.

As illustrated in FIGS. 2 and 3 to which detailed reference will next be made, the top of the vessel is divided longitudinally into three compartments, A, B and C, each of which is covered by a lid 36. These figures along with FIGS. 1 and 4 show that housed beneath each lid is a skimmer subassembly that has been indicated broadly by reference numeral 38 and which comprises an endless belt and flight conveyor running horizontally instead of vertically. One such subassembly is provided in each compartment and they function to skim the oil floating on top of the water both off to one side and into overflow launders 40 positioned alongside each compartment.

As is most clearly seen in FIG. 4, one side wall 24S of the vessel is shorter than the other and its upper edge is folded over to produce a wier 42 over which the oil is swept by the skimmer subassemblies 38 into the launders alongside thereof. In FIG. 2 it can be seen that each launder 40 has a hopper-like sloping bottom 44 that collects the oil at discharge openings 46 which lead into oil collection lines 48.

Looking next at FIGS. 1 and 4, it can be seen that single common drive and driven shafts 50 and 52, respectively, are journalled for rotation along opposite sides of the vessel 12 near its top edge and above wier 42. Rollers 54 are fixed to each shaft for rotation therewith within each of the three compartments in transversely-aligned relation. An endless belt 56 carrying the paddle-like flights 58 is reaved around each pair of rollers to complete the skimmer subassembly. A gear motor or similar drive 60 connected to drive shaft 50 drives all three skimmer subassemblies simultaneously and in a direction to skim the oil into the overflow launders. Other arrangements can, of course, be used to drive the skimmers including that of taking the power to drive them from the main drive 62 that operates the counterrotating screws.

As seen in FIGS. 1, 3 and 4, the main vessel 12 is shown mounted on I-beams 64 but, here again, any suitable base will suffice and could, if necessary, be used in place thereof. Likewise, the vessel 12 is shown with its bottom and both sides covered with a jacket 66 through which water, steam or some other heat exchange medium can be circulated in sufficient quantities and at a high enough temperature to maintain the water inside the vessel at between approximately 180°–200° F. Steam jacketed vessels are well known in the art and no claim is predicated thereon. Instead, the only significance of the jacketed vessel is to provide an environment where the water bath will be maintained within the aforementioned temperature range.

Drive 62 for the screw conveyors is, likewise, conventional and, in the particular form shown it includes a belt and pulley drive from a prime mover (not shown) that is effective to rotate input shaft 68. Input shaft 68, in turn, rotates the right screw conveyor shaft 70R by means of meshed gears 72 and 74. Shaft 70R also carries a second gear 76 which meshes with idler 78 that in turn meshes with gear 80 on shaft 70L to rotate the latter in a direction opposite to that in which shaft 70R turns. The auger flighting 82R and 82L must be of the opposite hand in order for both screws when turned in opposite directions (see arrows in FIG. 4) to drive the sand forwardly toward the discharge end, i.e. the right-hand shaft 70R turns counterclockwise when viewed from the intake end of the cell and its flighting 82R must, therefore, have a right-hand thread to drive the sand forwardly. Conversely, shaft 70L turns clockwise as seen from the intake end and its flighting 82L must, therefore, be left handed to advance the sand. Gear train 72–80 is housed in a suitable housing 84 as shown.

Now, with particular reference once again to FIGS. 1, 3 and 4, it will be seen that a pipe 86 runs along the bottom of the vessel between the screws from the intake end to a point of termination just short of box 88 where the clean sand is collected preparatory to being dumped out the bottom through pipes 90. This pipe 86 has apertures 92 spaced along the top as well as on both sides thereof (see FIG. 1).

At the point where pipe 86 enters the bulkhead or end wall 22 at the front end of the vessel, it is fitted with an air-aspirating venturi 94 of conventional design. Water enters the venturi and aspirates air in the conventional manner preparatory to discharging same underneath the sand lying in the bottom of the cell. As the screws turn, they rub and abraid the sand grains together freeing the oil particles therefrom; however, these particles easily become physically trapped in the sand despite the fact that they no longer coat same. It has been found that by simultaneously flushing and aerating this sand while it is being tumbled, the rising air bubbles push the oil particles through the sand and carry them to the surface where they can be scavanged. It is significant that the aeration be in the form of very tiny bubbles that will migrate upwardly through the sand without unduly agitating it to the point where some of it is pushed all the way to the surface of the water bath to become recoated with oil and be swept off into the launder by the skimmer.

Figure 6:
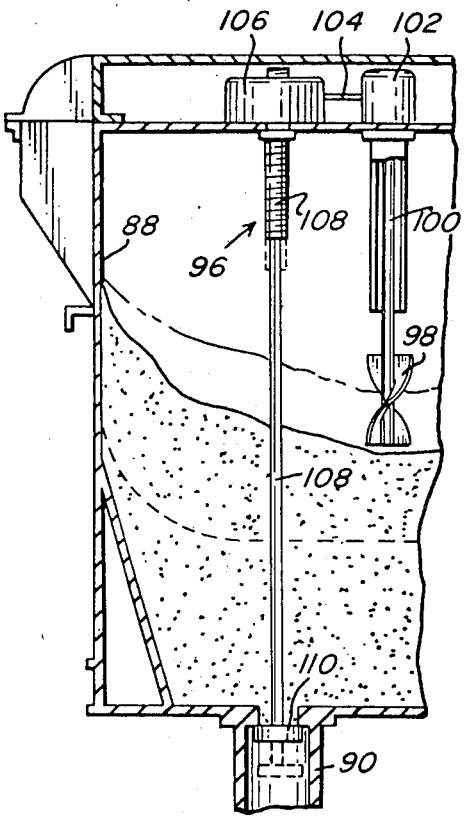

Finally, with brief reference to FIG. 6 it will be seen that box 88 containing the bottom-dump tubes or pipes 90 is fitted with a plurality of valve subassemblies that have been indicated in a general way by reference numeral 96 and which are, once again, of conventional construction, the particular one illustrated being similar to that which forms subject matter of U.S. Pat. No. 3,129,849. Essentially, the build-up of sand in the bottom of box 88 is sensed by rotating paddle 98. As this paddle encounters increased resistance toward rotation by reason of the build-up of sand therearound, its shaft 100 torques against the action of a tension spring (not shown) housed in housing 102. This turning action closes an electrical circuit represented by link 104 that energizes a motor 106 which screws shaft 108 down and opens valve 110 thus allowing sand to escape through pipe 90. Once the level of the sand has dropped below paddle 98 so that it can turn freely again, the spring inside housing 102 returns the electrical circuit to its original condition where it becomes operative to turn shaft 108 in the reverse direction thus reclosing valve 110 before shutting off and waiting for a subsequent initiation of its operating cycle. These valves are effective to intermittently and independently dump clean sand from box 88 without lowering the fluid level in the cell to a point below the level of the sand contained therein.

What is claimed is:

1. The method for removing water-immiscible bitumens and the like from the surface of tar-sands and separating same from the sand grains which includes the steps of: providing a vessel, introducing coated sand in the form of an aqueous slurry into the vessel, rubbing the coated sand grains together under water by tumbling them in a generally downward direction between two counterrotating screw conveyors to rub the grains together and scrub water immiscible materials from the surface thereof, bubbling an air-water mixture up through the descending sand grains at a rate and in a quantity effective to lift the immiscibles free of the sand and deposit same on the surface of the water without inducing undue turbulence of a degree which would result in sand particles being elevated to the surface of the water bath where the freed immiscibles are located so that said washed sand does not contact said surface-located freed immiscibles while simultaneously washing the sand with said water so that said water and air bubbles are directed upwardly through said slurry simultaneously with said rubbing effected by said screw conveyors, skimming the immiscibles thus deposited off the surface of the water while moving the progressively cleaner sand grains toward one end by means of the screw conveyors, and dumping the clean sand out the bottom while maintaining the water level above that of the sand.

2. The method as set forth in claim 1 wherein the sand is tumbled down between the screw conveyors and the air-water mixture rises therebetween in countercurrent flow relation to said descending sand.

3. The method as set forth in claim 1 wherein the immiscibles floating on the surface of the water are skimmed off to one side while the progressively cleaner sand is moved along toward one end.

4. The method as set forth in claim 1 in which the build-up of sand is sensed and its build-up to a predetermined level is used to dump same before its level rises above that of the water.

* * * * *